US007285771B2

(12) United States Patent
Walker

(10) Patent No.: US 7,285,771 B2
(45) Date of Patent: Oct. 23, 2007

(54) OPTICAL SENSOR

(75) Inventor: Steven H. Walker, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 452 days.

(21) Appl. No.: 10/761,719

(22) Filed: Jan. 20, 2004

(65) Prior Publication Data

US 2005/0156980 A1 Jul. 21, 2005

(51) Int. Cl.
*H01J 40/14* (2006.01)
*B41J 29/393* (2006.01)

(52) U.S. Cl. ..... 250/239; 250/559.16; 250/559.4; 250/234; 347/19

(58) Field of Classification Search ..... 250/559.16, 250/559.17, 559.28, 559.4, 234, 239, 231.13; 347/16, 19, 105
See application file for complete search history.

(56) References Cited

U.S. PATENT DOCUMENTS 5,078,497 A * 1/1992 Borton et al. ..... 356/446
5,107,130 A 4/1992 Frese
5,130,531 A 7/1992 Ito et al.
5,170,047 A 12/1992 Beauchamp et al.
5,250,813 A 10/1993 Takahashi et al.
5,404,020 A 4/1995 Cobbs
5,861,899 A 1/1999 Nguyen et al.
5,883,846 A 3/1999 Beauchamp
5,905,512 A 5/1999 Beauchamp
6,036,298 A 3/2000 Walker
6,137,508 A 10/2000 Gaarder
6,244,682 B1 6/2001 Walker et al.
6,265,709 B1 7/2001 Olson et al.
6,322,192 B1 11/2001 Walker
6,325,505 B1 12/2001 Walker
6,352,332 B1 3/2002 Walker
6,485,124 B1 11/2002 King et al.
6,561,643 B1 5/2003 Walker et al.
6,585,341 B1 7/2003 Walker et al.
2002/0101469 A1 8/2002 Wade et al.
2003/0001939 A1 1/2003 Scofield et al.
2003/0095163 A1 5/2003 Otsuki et al.
2005/0073544 A1 * 4/2005 Scofield et al. ..... 347/16

* cited by examiner

*Primary Examiner*—Kevin Pyo

(57) ABSTRACT

An optical sensor assembly includes a housing and a light source within the housing and a plurality of sensors within the housing, the sensors being configured to detect reflections of the light from a piece of media or other object adjacent the housing.

9 Claims, 6 Drawing Sheets

FIG. 2
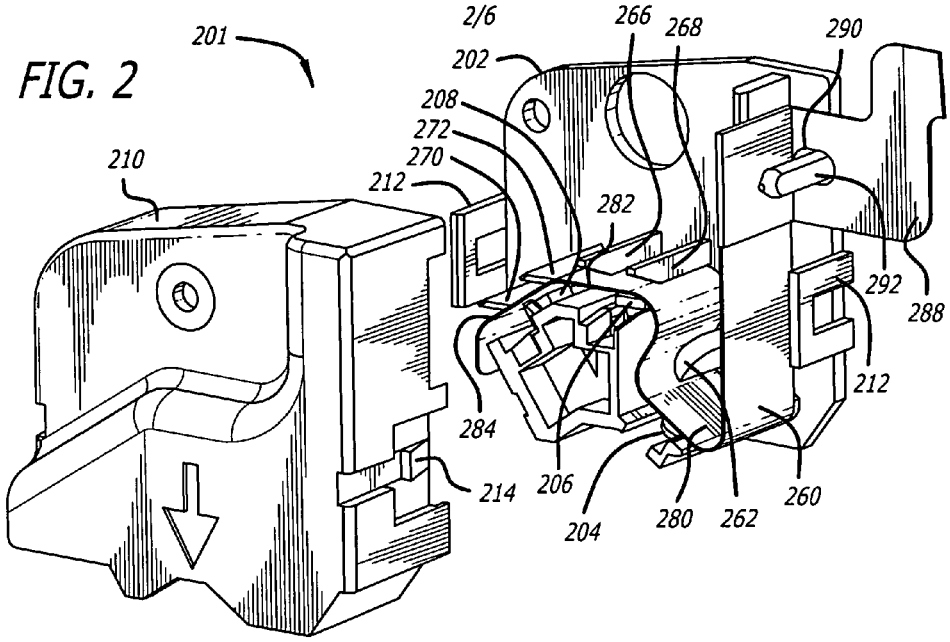
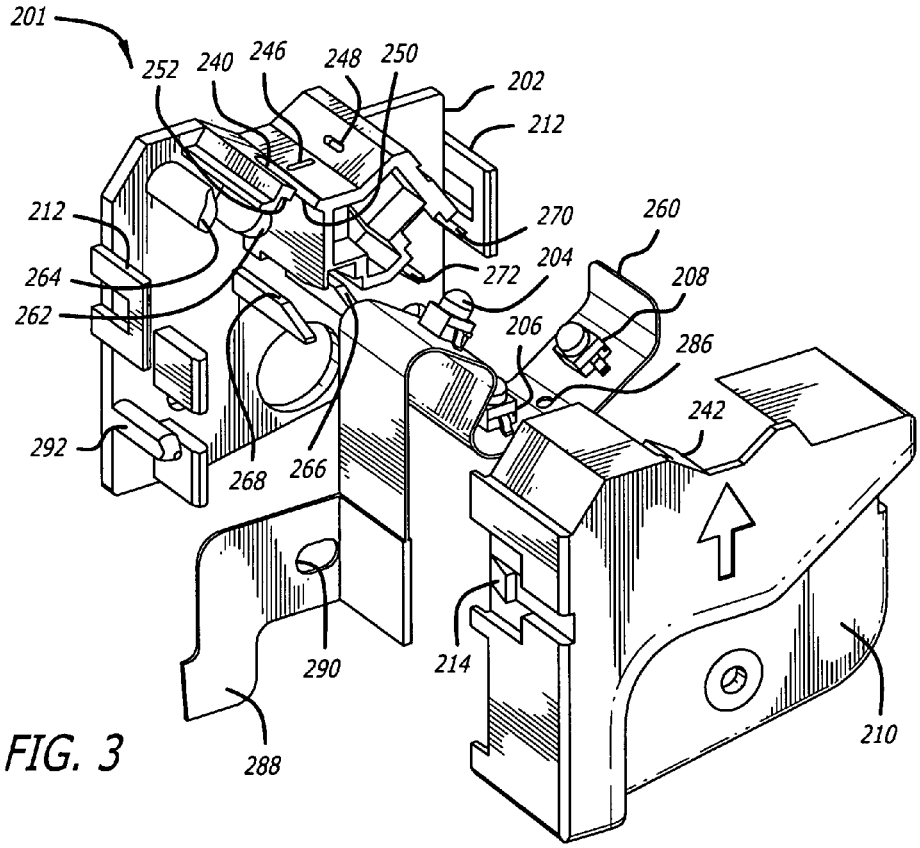
FIG. 3

FIG. 4
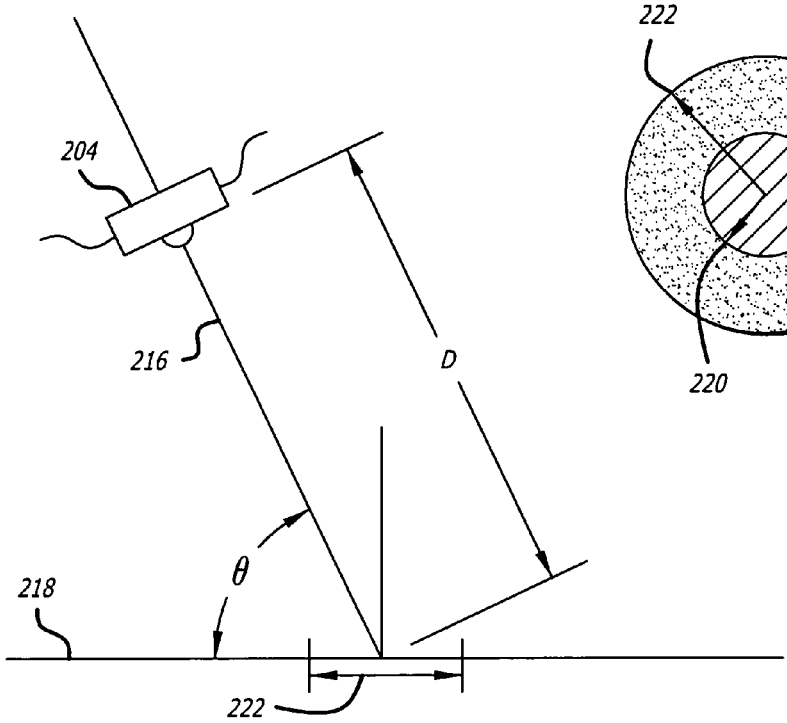
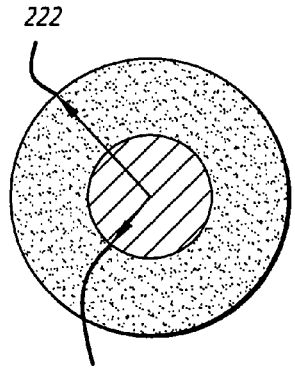
FIG. 5
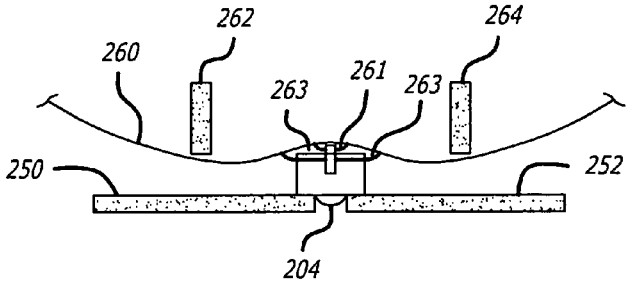
FIG. 6
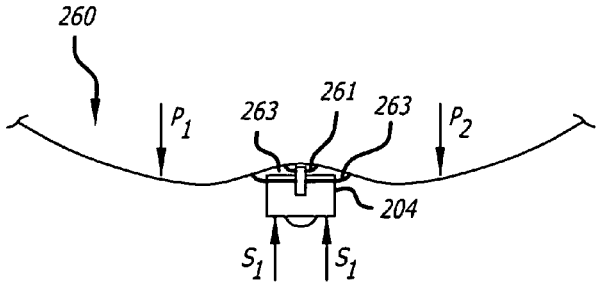
FIG. 7

204
SMALL LENS RADIUS
230
234
232
220
100 % IN TARGET ZONE
D 230
234
232
LARGE LENS RADIUS
204
220
56 % IN TARGET ZONE

204
DEEP
DIE
PLACEMENT
230
234
232
N+A
220
56 %
IN
TARGET
ZONE
IDENTICAL
LENS
RADIUS
D 230
234
232
N-A
204
SHALLOW
DIE
PLACEMENT
220
100 %
IN
TARGET
ZONE

OPTICAL SENSOR

BACKGROUND

Some printing mechanisms such as Inkjet printers include sensors that facilitate pen alignment, media type detection, media edge detection, and/or other functions. Unfortunately, many prior sensors—particularly, sensors that have high margins for aerosol, paper dust, ambient light and page life—are too costly to be incorporated into the low cost printing mechanisms demanded by consumers today. The high price of such sensors effectively forecloses their inclusion in printing mechanisms which themselves have virtually become consumables. It would be desirable to be able to provide a low cost optical sensor suitable for such printing mechanisms.

BRIEF DESCRIPTION OF THE DRAWINGS

Detailed description of embodiments of the invention will be made with reference to the accompanying drawings:

FIG. 2 is a partially exploded perspective view of an example optical sensor according to an embodiment of the present invention;

FIG. 3 is an alternate exploded perspective view of the optical sensor of FIG. 2;

FIG. 4 is an illustration of an example light source/target surface configuration according to an embodiment of the present invention;

FIG. 5 is an illustration of an example target area within a sample area;

FIG. 6 is a partial view of an example flexible printed circuit assembly (FPCA) according to an embodiment of the present invention, illustrating a reverse bow in the FPCA which holds a component against datum surfaces;

FIG. 7 is a free body diagram of the FPCA of FIG. 6 showing forces $P_1$ and $P_2$ exerted on the FPCA by pylons and forces $S_1$ and $S_2$ exerted on either side of the component lens by datum surfaces;

DETAILED DESCRIPTION

The following is a detailed description for carrying out embodiments of the invention. This description is not to be taken in a limiting sense, but is made merely for the purpose of illustrating the general principles of the example embodiments of the invention.

Figure 1:
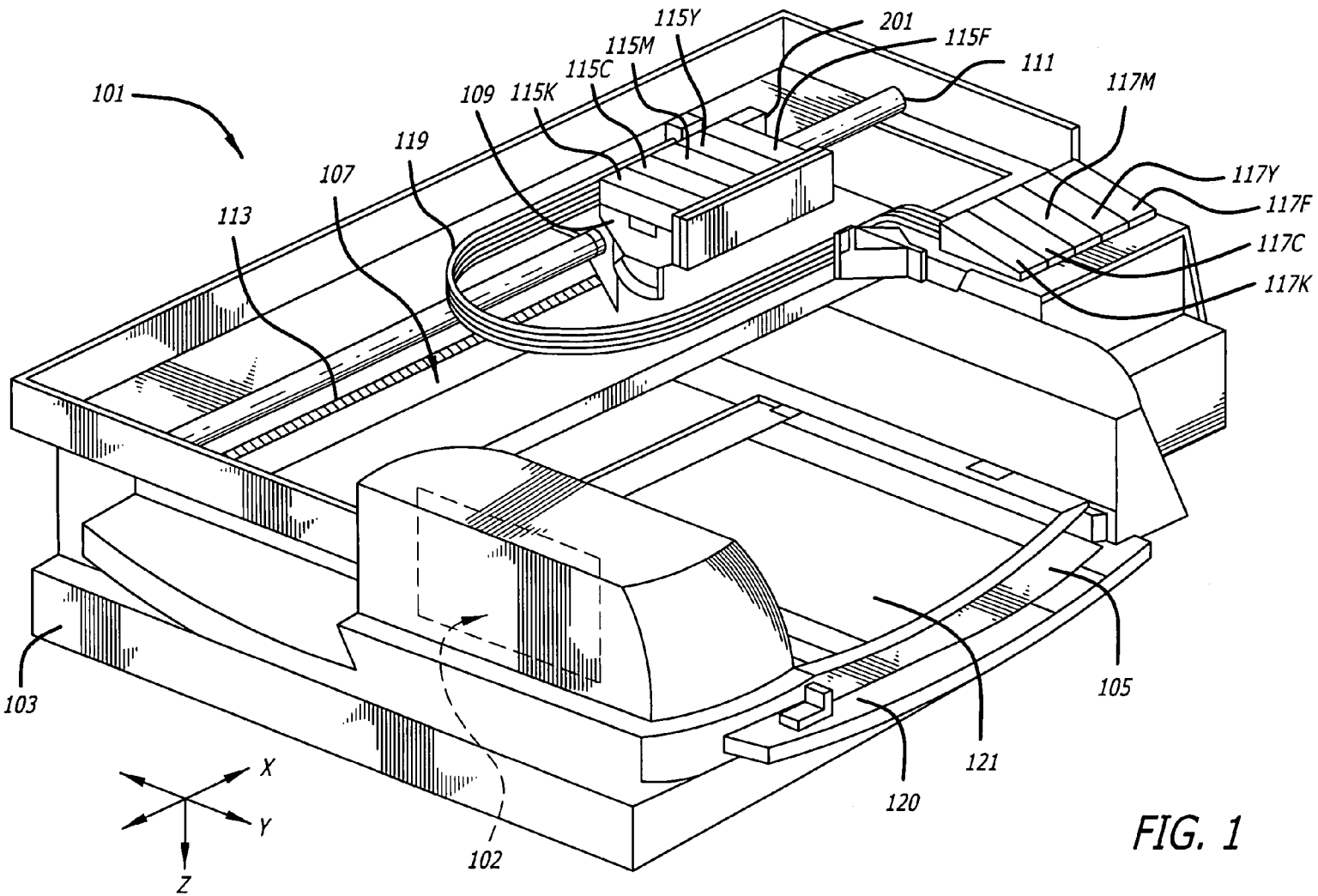
FIG. 1 is a perspective view of an example inkjet printer according to an embodiment of the present invention.

FIG. 1 depicts an inkjet hard copy apparatus, in this example embodiment, a computer peripheral, color printer 101. A housing 103 encloses the electrical and mechanical operating mechanisms of the printer 101. Operation is administrated by an internal electronic controller 102 (usually a microprocessor or application specific integrated circuit ("ASIC") controlled printed circuit board) connected by appropriate cabling (not shown) to the computer. For example, imaging, printing, print media handling, and control functions are executed by the controller 102. Cut-sheet print media 105 is loaded by the end-user onto an input tray 120. Sheets of the print media 105 media are then sequentially fed by a suitable, internal, paper-path transport mechanism to a printing station pivot, "printing zone," 107—also referred to in the art as a "platen"—where graphical images or alphanumeric text are created using color imaging and text rendering techniques. A carriage 109, mounted on a slider 111, scans the media sheet delivered to the printing zone 107. An encoder strip 113 and appurtenant position encoding devices on the carriage 109 and as part of the controller 102 firmware are provided for keeping track of the position of the carriage 109 at any given time during a scan across the paper. A set of individual Inkjet writing instruments, "pens," 115K, 115C, 115M, 115Y, 115F, each having Inkjet printheads (not seen in this perspective), are releasably mounted in fixed positions on the carriage 109 for easy access and repair or replacement. Each printhead mechanisms is adapted for "jetting" minute droplets of ink or other fluids to form dots on adjacently positioned paper in the printing zone 107. Refillable or replaceable ink cartridges 117K, 117C, 117M, 117Y are provided; generally, in a full color Inkjet system, inks for the subtractive primary colors, Cyan, Yellow, Magenta (CYM) and a true black (K) ink are used. However, additive primary colors—red, blue, green—or other. colorants can be used. In this set, a pen 115F and cartridge 117F for a clear fluid, ink fixer "F," are also provided. The pens 115 are coupled to their respective cartridges by a flexible ink feed tubing 119. Once a printed page is completed, the sheet of media is ejected onto an output tray 121. The pen scanning direction is referred to as the x-axis, the paper feed direction as the y-axis, and the ink drop firing direction as the z-axis. Ink-jet nozzles of the printheads are generally in-line with an optical sensor assembly or sensor module 201 in the x-axis by fixedly mounting the module 201 appropriately on the carriage 109. An example embodiment of an optical sensor assembly according to the present invention is described below.

Referring to FIGS. 2 and 3, an optical sensor assembly 201 according to an example embodiment of the present invention includes a housing 202 and a light source 204. In this embodiment, the light source 204 is positioned within the housing 202 and configured to emit light predominantly of a red color (e.g., to emit light with a maximum intensity corresponding to a wavelength, $\lambda$, of approximately 640 nm). It should be appreciated, however, that light sources emitting light of different colors can also be used.

The optical sensor assembly 201 in this example embodiment also includes a mechanism for detecting diffuse and specular reflections of the light (emitted by the light source 204) from a piece of media or other object adjacent to the housing 202. In this embodiment, the mechanism for detecting diffuse and specular reflections includes sensors 206 and 208 positioned within the housing 202. By way of example, the light source 204 can be a light emitting diode (LED) and the sensors 206 and 208 can be phototransistors (PTRs).

In this example embodiment, the optical sensor assembly 201 also includes a cover 210 for the housing 202. The cover 210 is formed with surfaces complementary to those of the housing 202. In the illustrated example, the cover 210 is snapped onto the housing 202 locking the components into place and shielding them from external light sources. To this end, the housing 202 and cover 210 respectively include latch members 212 and latch engaging members 214 which are configured in a complementary fashion as shown. It should be appreciated that the housing 202 and the cover 210 can be shaped and secured together in a variety of different ways.

Referring to FIG. 4, the light source 204 is shown—alone for purposes of illustrative clarity—with its illumination centerline 216 incident upon a target surface 218 (e.g., a piece of media). The centerline 216 forms an angle of incidence, θ, with the target surface 218. In this example embodiment of the optical sensor assembly 201, the light source 204 is aligned at an angle of 56 degrees with respect to a measured surface of the piece of media. It should be appreciated, however, that the light source 204 can be configured differently within the housing 202 such that the light source 204 is aligned at other angles with respect to a measured surface of the piece of media or other object.

Referring also to FIG. 5, the light source 204 is configured according to various embodiments of the present invention to direct at least a minimum percentage of its total power to a target area (or zone) 220 within a sample area (or zone) 222. In an embodiment of the present invention directed toward employing the optical sensor assembly 201 to detect a type of media, a minimum percentage of the total power directed to a target zone 220 is approximately 27%. It has been observed that the percentage of power in the target zone affects the response of the sensor to the glass level of the media. As discussed below, a variety of different light sources can be employed, for example, LEDs with light source lens radiuses and/or light source die placements selected depending upon the particular application (e.g., referring to FIG. 4, taking into consideration the angle of incidence, θ, and the distance, D, between the light source 204 and the target surface 218.)

Figures 8, 9:
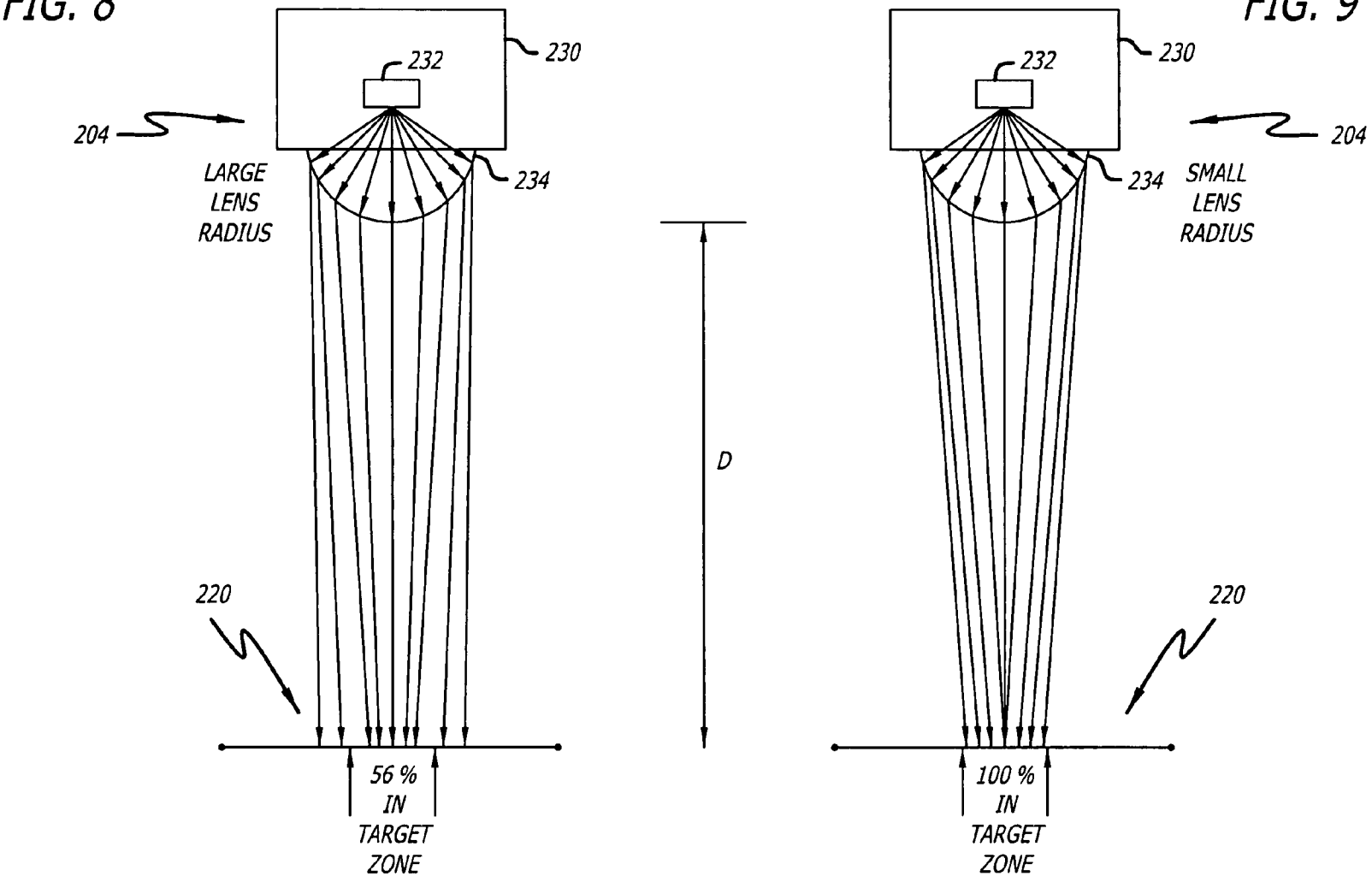
FIGS. 8 and 9 illustrate variations in percentage of power in target area with different light source lens radiuses.

FIGS. 8 and 9 illustrate variations in percentage of power in target area with different light source lens radiuses. In FIG. 8, the example light-emitting-diode (LED) assembly 204 includes an enclosure 230 (e.g., a subminiature surface mount package), a voltage-controlled photon emitting material 232 positioned within the enclosure 230, and a lens 234 attached (e.g., molded) to the enclosure 230. In this embodiment, the lens 234 is shaped as shown (with a "large lens radius") to direct at least a minimum percentage (e.g., 56%) of total power generated by the voltage-controlled photon emitting material 232 to a target zone 220 outside the enclosure 230. In this embodiment, the lens 234 has a radius sufficiently small given a distance between the lens 234 and the voltage-controlled photon emitting material 232 to ensure that at least the minimum percentage of total power is directed to the target zone 220. In FIG. 9, the light-emitting-diode (LED) assembly 204 is provided with a lens 234 that is shaped as shown (with a "small lens radius") to direct a higher percentage (e.g., 100%) of the total power generated by the voltage-controlled photon emitting material 232 to the target zone 220. It should also be appreciated that the lens 234 does not have to be circular in shape, i.e., different lens profiles can be used. For example, the lens 234 can be shaped to provide a circular area of target illumination for a particular angle of incidence, or to provide a non-circular area of target illumination.

Figures 10, 11:
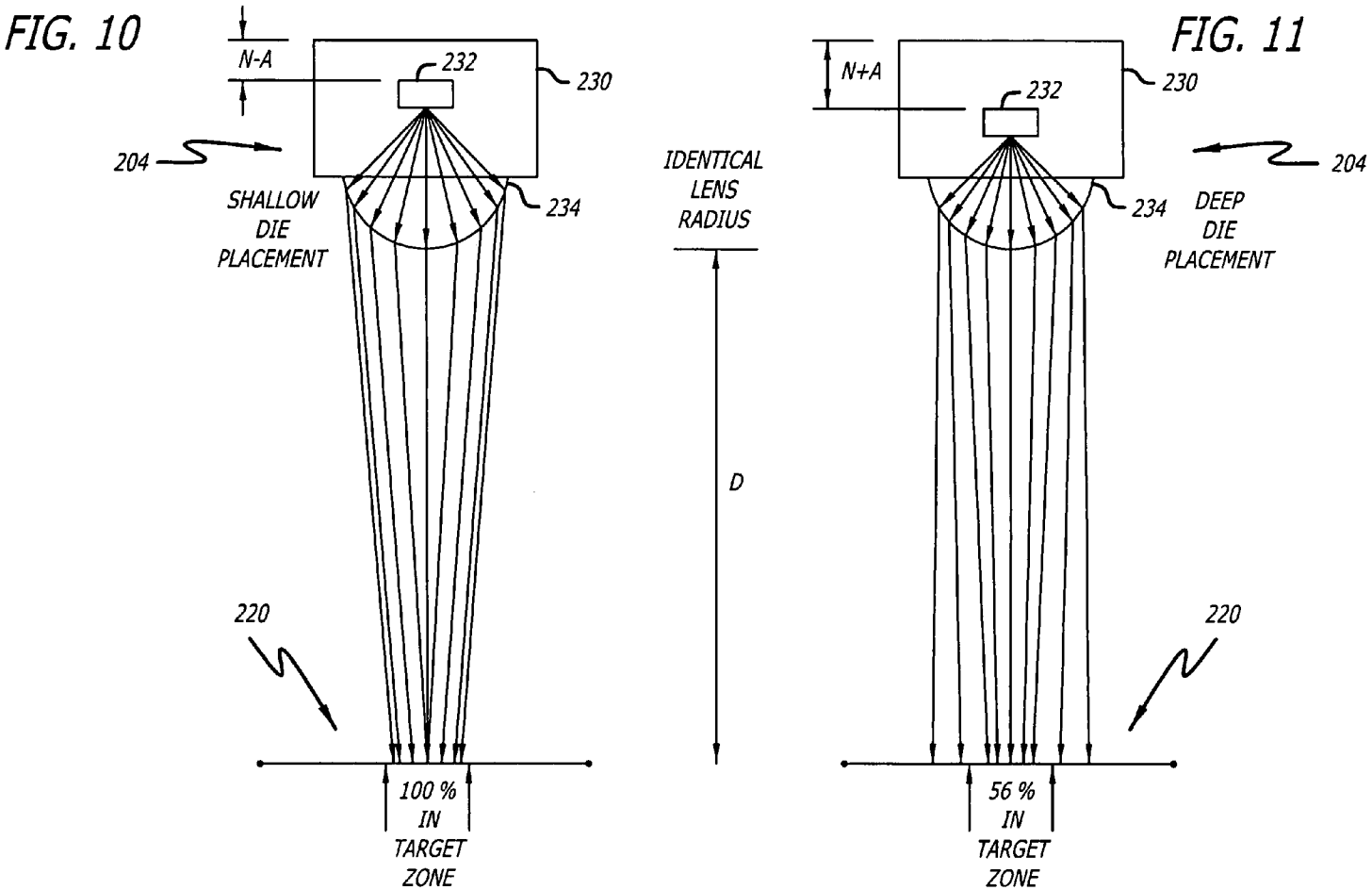
FIGS. 10 and 11 illustrate variations in percentage of power in target area with different light source die placements.

FIGS. 10 and 11 illustrate variations in percentage of power in target area with different light source die placements. In both of these figures, the example light-emitting-diode (LED) assembly 204 includes an enclosure 230 (e.g., a subminiature surface mount package), a voltage-controlled photon emitting material 232 positioned within the enclosure 230, and a lens 234 attached (e.g., molded) to the enclosure 230. The lenses 234 in FIGS. 10 and 11 have identical radiuses; however, the die placements within the enclosures 230 are different. In FIG. 11, the voltage-controlled photon emitting material 232 is positioned within the enclosure 230 and relative to the lens 234 as shown (with a deep die placement, N+A, within the enclosure 230) such that at least a minimum percentage (e.g., 56%) of total power generated by the voltage-controlled photon emitting material 232 is directed to a target zone 220 outside the enclosure 230. In this embodiment, the voltage-controlled photon emitting material 232 is positioned sufficiently far away from the lens 234 given a profile of the lens 234 to ensure that at least the minimum percentage of total power is directed to the target zone 220 which is at a distance, D, from the lens 234. In FIG. 10, the voltage-controlled photon emitting material 232 is positioned within the enclosure 230 and relative to the lens 234 as shown (with a shallow die placement, N−A) such that a higher percentage (e.g., 100%) of the total power generated by the voltage-controlled photon emitting material 232 is directed to the target zone 220.

Referring again to FIGS. 2 and 3, in this example embodiment, the housing 202 includes a slot 240 through which the light source 204 is partially extended. The cover 210 includes a tab member 242 sized to fit within the slot 240 adjacent the light source 204. In this example embodiment, the housing 202 also includes apertures 246 and 248 formed as shown. In this example embodiment, the aperture 246 is oriented at 90 degrees with respect to the measured surface of the media and the aperture 248 is oriented at 56 degrees with respect to the media surface. The sensors 206 and 208, within the housing 202, are coaxial with the apertures 246 and 248, respectively. In an example embodiment, the "working distance" between each of the apertures 246 and 248 and the piece of media (or other object) nominally is 2.2 mm±0.5 mm, and the apertures 246 and 248 are approximately equidistant between the sensors 206 and 208, respectively, and the media surface. The apertures 246 and 248 are configured to control the resolution and energy collection of the sensors 206 and 208, respectively. In this example embodiment, the aperture 246 functions as a diffuse reflection collecting aperture and the aperture 248 functions as a specular reflection collecting aperture. The light source 204 is positioned within the housing 202 such that the centerline of its illuminance is at the same angle (in this example embodiment, 56 degrees) with respect to the media as the specular reflection collecting aperture 248. In other words, the aperture 248 is oriented to capture the specular reflection of the light source 204 from the piece of media or other object.

In this example embodiment, the sensors 206 and 208 are configured to have ellipse-shaped fields of view with respect to the piece of media or other object. In this example embodiment, major axes of the ellipse-shaped fields of view are approximately orthogonal to each other. The fields of view of the sensors 206 and 208 are determined by the shape of the apertures 246 and 248, respectively, by the shape of the lenses of the sensors 206 and 208, and by the distance between the lenses of the sensors 206 and 208 and the media surface. In this example embodiment, the ellipse-shaped fields of view intersect at their z-axes. In this example embodiment, the field of view of the sensor 206 (the "diffuse FOV") has a field of view diffuse y-axis (FOVDY) of 1.25 mm-2.0 mm and a field of view diffuse x-axis (FOVDX) of 0.9 mm-1.25 mm. In this example embodiment, the field of view of the sensor 208 (the "specular FOV") has a field of view specular x-axis (FOVSX) of 1.5 mm-2.5 mm and a field of view specular y-axis (FOVSY) of 1.1 mm-1.6 mm. Thus, in this example embodiment, the sensors 206 and 208 are configured to have fields of view no greater than 2.5 mm at the working distance. It should be appreciated, however, that the optical sensor assembly 201 can be configured to provide the sensors 206 and 208 with fields of view that have different shapes, sizes and/or orientations.

In this embodiment of the present invention, there are no "secondary lenses" between the sensors 206 and 208 and the media surface; however, the sensors 206 and 208 themselves may each include a lens as part of the component package. In this embodiment, the proximity of the optical sensor assembly 201 to the media eliminates the need for a secondary lens or blocking filters to protect against ambient light. Thus, an optical sensor assembly according to an example embodiment of the present invention includes a housing, a source of light within the housing, and a plurality of sensors within the housing, the sensors being configured to detect diffuse and specular reflections of the light from an object adjacent the housing, with no secondary lenses being positioned between the sensors and the object.

In this example embodiment, the housing 202 also includes datum surfaces against/into which the light source 204 and the sensors 206 and 208 are positioned. Referring to FIG. 3, inside the housing 202 at opposing sides of the slot 240, datum surfaces 250 and 252 are provided for the light source 204. In this example embodiment, the optical sensor assembly 201 also includes a mechanism for positioning the light source 204 and the sensors 206 and 208 against the housing 202. In this example embodiment, the mechanism for positioning includes a flexible printed circuit assembly (FPCA) 260 within the housing 202. In this example embodiment, one or more of the light source 204 and the sensors 206 and 208 are mounted to the FPCA 260, and the mechanism for positioning further includes pylon members, e.g., projections from the inside of the housing 202. In this example embodiment, the FPCA 260 is threaded through pylon members 262, 264, 266, 268, 270, 272 which are positioned as pairs of pylon members on either side of each component datum, contacting the FPCA 260 on the side opposite the mounted component. In this example embodiment, the pylon members 262, 264, 266, 268, 270, 272 are positioned within the housing 202 and configured as shown to impart forces against the FPCA 260, anchoring the light source 204 and the sensors 206 and 208 against the inside of the housing 202. FIG. 6 shows a portion of the FPCA 260 to which the light source 204 is secured. This figure illustrates a reverse bow in the FPCA 260, imparted by the pylons 262 and 264, which holds the light source 204 on opposing sides of the component lens against the datum surfaces 250 and 252. FIG. 7 is a free body diagram of the FPCA 260 of FIG. 6 showing the forces $P_1$ and $P_2$ exerted on the FPCA 260 by the pylons 262 and 264, respectively, and the forces $S_1$ and $S_2$ exerted on either side of the component lens by the datum surfaces 250 and 252, respectively. The pylons are distanced from the datum surfaces so that the FPCA is slightly deflected as it passes under the pylons. This deflection creates a force directed against the face of the component contacting the datum surface. The force serves to hold the component in place.

Referring again to FIGS. 2 and 3, an embodiment of the optical sensor assembly 201 also includes a mechanism for altering a stiffness modulus at one or more (discrete) positions along the FPCA 260. By way of example, the mechanism for altering a stiffness modulus includes one or more stiffening members positioned on opposites sides of the FPCA 260 from the light source and optical sensor components. In this example embodiment, stiffening members 280, 282 and 284 (e.g., pads) are positioned on the FPCA 260 opposite from the light source 204, sensor 206 and sensor 208, respectively. In this example embodiment, the pylon members 262, 264, 266, 268, 270, 272 are configured such that the stiffening members 280, 282 and 284 fit between the pylons. Also by way of example, the mechanism for altering a stiffness modulus includes one or more holes formed through the FPCA 260 between the components. In this example embodiment, a hole 286 is positioned along the FPCA 260 between the sensors 206 and 208. The one or more holes lower the modulus in the FPCA 260 to lessen any force which may twist the components as the FPCA 260 is bent to be routed through its slot in the housing 202. Accordingly, local stiffness (flexural modulus) of the FPCA can be controlled with stiffening pads joined to the FPCA and/or with holes formed through the FPCA. Thus, an optical sensor assembly according to an embodiment of the present invention includes a housing, a flexible printed circuit assembly (FPCA) within the housing, light source and optical sensor components secured to the FPCA, and a mechanism for altering a stiffness modulus at discrete positions along the FPCA. In this example embodiment, a portion 288 of the FPCA 260 exiting the housing 202 is folded at a right angle, and a reinforced hole 290 in the FPCA 260 is placed over a pin 292 attached to the housing 202. This serves as a strain relief to the FPCA 260.

In an embodiment of the present invention, one or more of the light source 204 and the sensors 206 and 208 are subminiature surface mount components (e.g., secured to the FPCA 260 with connectors built directly on the FPCA 260). By way of example, and referring also to FIGS. 6 and 7, one or more of the light source 204 and the sensors 206 and 208 are conductively connected to pads of the FPCA 260 with a conductive connecting material 261. In one embodiment, the conductive connecting material 261 is solder (e.g., tin-lead solder). In another embodiment, the conductive connecting material 261 is formed with a lead-free material (e.g., a silver conductive (thermosetting) epoxy). For both embodiments, a secondary non-conductive connecting material 263, for example, a non-conductive thermosetting resin, or cyanoacrylate glue, is applied around the perimeter of the component forming a fillet of adhesive that further mechanically attaches the component to the FPCA 260. The non-conductive connecting material 263 is applied around the perimeter of the components 204, 206 and 208 to counter the forces applied to the components during assembly. By way of example, the FPCA 260 is made from a polyimide material or a polyester material (e.g., the polyester material is based on Polyethylene Terephthalate (PET). Thus, an optical sensor assembly according to an embodiment of the present invention includes a housing, a flexible printed circuit assembly (FPCA) positioned within the housing, the FPCA being made of a polyester material, and light source and optical sensor components secured to the FPCA.

Polyimide can withstand temperatures of over 300° C. for short exposures. This enables a polyimide flex to withstand the temperatures of an infrared (IR) reflow soldering oven. Therefore, by way of example, according to an embodiment of the present invention, surface mount components can be soldered with lead-tin solder to a FPCA 260 made of polyimide in an IR reflow oven.

Polyester is inexpensive relative to polyimide, however, polyester is not sufficiently temperature resistant to be IR reflow soldered. In an embodiment of the present invention, the components are attached to a FPCA 260 made of polyester with conductive silver epoxy, curing the epoxy with ultra violet (UV) light. The temperature is kept below the combustion temperature of polyester (e.g. under about 110° C.) to avoid damage to the FPCA 260. In another embodiment including a FPCA 260 made of polyester with soldered components, the soldering process is not IR reflow but controlled point soldering. A temperature controlled iron tip is momentarily brought in contact with the pad while a machine feed string of solder is added to the hot tip and pad. A heat sink is incorporated against the back side of the pad. In this fashion, the heat input is keep to a minimum and the cooling is maximized. Therefore, the peak temp that the polyester is exposed to is reduced/keep below the combustion temperature.

Figure 12:
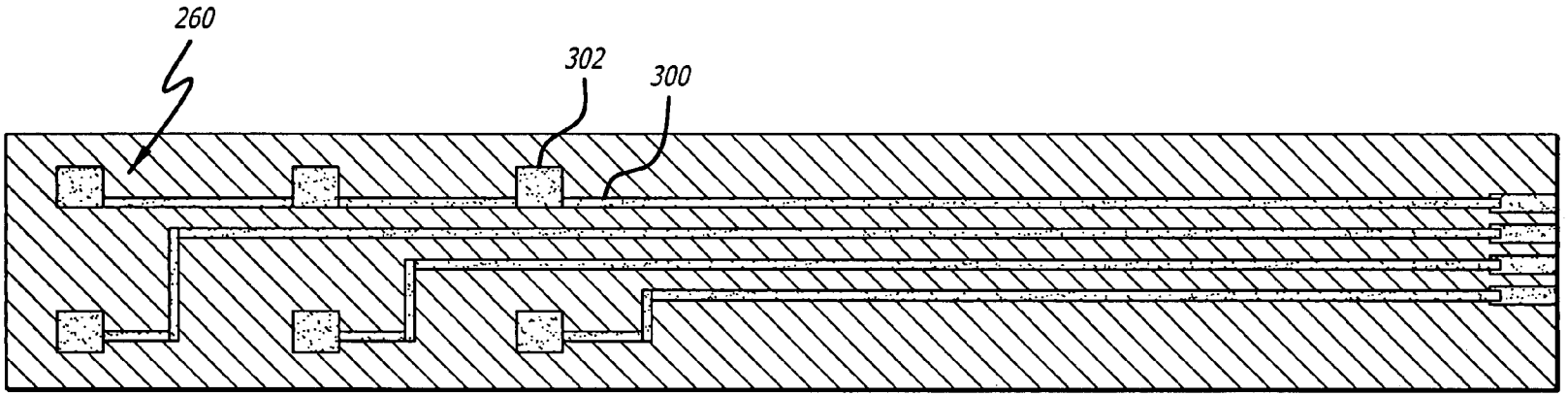
FIG. 12 is an illustration of an example polyester FPCA with copper traces and contact pads (negative process) according to an embodiment of the present invention.
Figure 13:
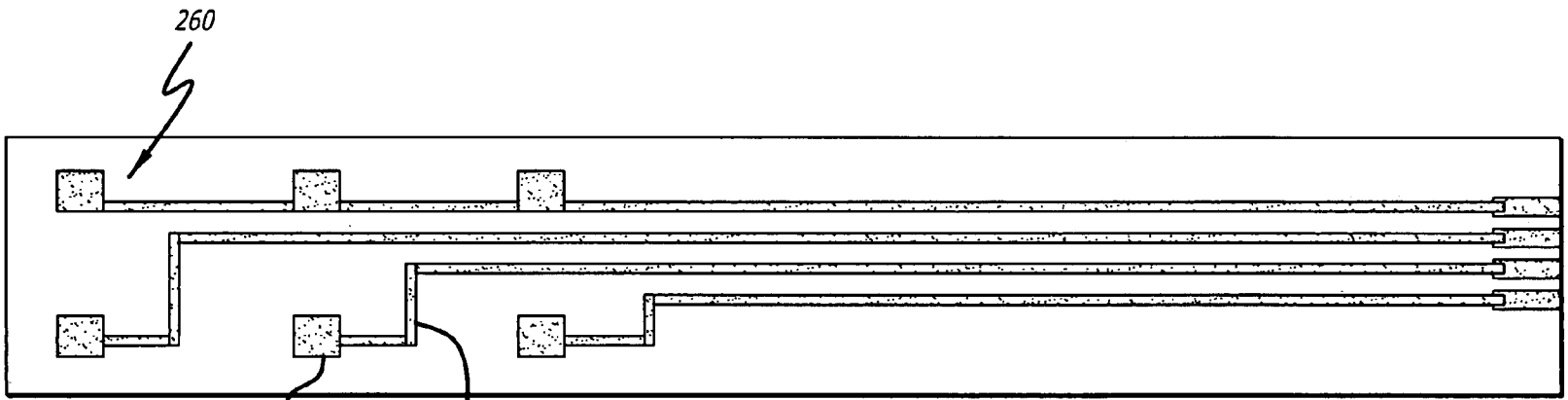
FIG. 13 is an illustration of an example polyester FPCA with screen printed conductive ink traces and contact pads (positive process) according to an embodiment of the present invention.

The FPCA 260 can be formed in a variety of different ways. Referring to FIG. 12, an example polyester FPCA 260 is shown with metal (e.g., copper) traces 300 and contact pads 302 (negative process). Referring to FIG. 13, an example polyester FPCA 260 is shown with screen printed conductive ink traces 304 and contact pads 306 (positive process). The dielectric strength of polyester is lower than that of polyimide. For a given stock thickness of film, the maximum applied voltage between adjacent traces is consequently lower for polyester than for polyimide. In an embodiment of the present invention that includes a polyester FPCA 260, the maximum voltage applied between adjacent traces is less than 32 Volts. A corresponding thickness in polyimide would be able to withstand over 1,000 Volts applied between adjacent traces.

In operation, the red illumination from the light source strikes the paper (media) surface and is reflected into the diffuse and specular sensors field of view. The magnitude and ratio of the energy captured by each sensor may be utilized to identify the type of media from which the light was reflected. Further identification may be found by moving (scanning) the sensor across the media surface acquiring signals from the diffuse and specular sensors at regular, spatially-sampled intervals. Frequency content in the scanned signal correlates to the stiffness of the media.

Reflectance signals are acquired while the module 201 is over the reflective media surface. The location of edges can therefore be found by scanning over an edge of the media. Correlating the appearance/disappearance of the reflective signals with the spatial position enables locating the media edge with respect to the printer's positional reference.

Cyan and black ink absorb the red (640 nm peak) wavelength light from the light source, which may comprise an LED. Thus scanning over a printed surface locates the position of the cyan and black ink drops. The reflected light signals drop when the sensor is positioned over the ink. This can be utilized to perform automated alignment of the inkjet printer's pens. In some embodiments, pen alignment may be inferred from alignment of any of a variety of pen colors. Aligning using cyan may be desirable in some implementations.

According to some embodiments of the present invention, cost savings are achieved through integration of printed circuit(s), connector(s), lenses, and mechanical mounting features. In contrast with prior solutions, and according to some embodiments, the minimalist optical sensor is placed closer to the media and therefore does not need a lens or blocking filters to protect against ambient light. Also, connectors are built directly on the carriage dimple. flex (FPCA), eliminating the expense for connectors on the sensor and carriage PCA. Additionally, embodiments of the optical sensor may use only one inexpensive red LED as a light source.

Although the present invention has been described in terms of the example embodiments above, numerous modifications and/or additions to the above-described embodiments would be readily apparent to one skilled in the art. It is intended that the scope of the present invention extends to all such modifications and/or additions.

I claim:

1. An optical sensor assembly comprising:

a housing;

only one light source within the housing, the light source being configured to emit light predominantly of a red color; and sensors within the housing, the sensors being configured to detect diffuse and specular reflections of the light from an object;

wherein the housing includes a plurality of apertures against which the sensors are coaxially aligned, the apertures being shaped and positioned relative to the sensors to control resolution and energy collection of the sensors.

2. The optical sensor assembly of claim 1, wherein the plurality of apertures are elongated slots that have substantially orthogonal longitudinal axes.

3. The optical sensor assembly of claim 1, wherein the plurality of apertures include a diffuse reflection collecting aperture aligned at an angle of 90 degrees with respect to a measured surface of the object.

4. The optical sensor assembly of claim 1, wherein the plurality of apertures include a specular reflection collecting aperture aligned at an angle of 56 degrees with respect to a measured surface of the object.

5. The optical sensor assembly of claim 1, wherein the light source is configured to emit light with a maximum intensity corresponding to a wavelength, $\lambda$, of approximately 640 nm.

6. The optical sensor assembly of claim 1, wherein the light source is a light emitting diode (LED).

7. The optical sensor assembly of claim 1, wherein the plurality of sensors are phototransistors (PTRs).

8. An optical sensor assembly comprising:

a housing;

only one light source within the housing, the light source being configured to emit light predominantly of a red color; and sensors within the housing, the sensors being configured to detect diffuse and specular reflections of the light from an object;

wherein the light source is aligned at an angle of 56 degrees with respect to a measured surface of the object.

9. An imaging device comprising:

an optical sensor including a housing, only one light source within the housing, the light source being configured to emit light predominantly of a red color, and sensors within the housing, the sensors being configured to detect diffuse and specular reflections of the light from an object;

means for scanning the object with the optical sensor, the means for scanning including a carriage to which the optical sensor is attached; and a controller for keeping track of the position of the carriage at any given time during a scan of the object.

* * * * *